United States Patent [19]

Elhaus et al.

[11] 4,224,816

[45] Sep. 30, 1980

[54] METHOD OF AND AN APPARATUS FOR PRODUCING EXTRUSION PROFILES

[75] Inventors: Friedrich W. Elhaus, Jägerhofstr. 117a, D-5600 Wuppertal, Fed. Rep. of Germany; Peter Stücker, Hagen, Fed. Rep. of Germany

[73] Assignee: Friedrich W. Elhaus, Wuppertal, Fed. Rep. of Germany; by said Peter Stücker

[21] Appl. No.: 958,999

[22] Filed: Nov. 9, 1978

[30] Foreign Application Priority Data

Nov. 14, 1977 [DE] Fed. Rep. of Germany ..... 2750899

[51] Int. Cl.[3] ..... B21C 31/00; B21C 51/00

[52] U.S. Cl. ..... 72/9; 72/8; 72/14; 72/21; 72/22; 72/10; 72/11; 72/254; 72/257; 72/253 R

[58] Field of Search ..... 72/253, 271, 8, 9, 14, 72/21, 22, 10, 11, 12, 15, 254, 255

[56] References Cited

U.S. PATENT DOCUMENTS 3,649,816 3/1972 Johnes ..... 72/21

FOREIGN PATENT DOCUMENTS 1193848 6/1970 United Kingdom ..... 72/271

*Primary Examiner*—Lowell A. Larson

*Attorney, Agent, or Firm*—Lawrence E. Laubscher

[57] ABSTRACT

A method is disclosed for producing extrusion profiles of a desired length, including the steps of processing a billet of preselected billet length in a press, measuring the extruded length during the extrusion process, and either switching off the extrusion process upon reaching the desired extruded length and varying the billet length such as to obtain the optimum butt thickness, or switching off the extrusion process upon reaching the minimum permissible butt thickness and enlarging the billet length such as to obtain the desired extrusion length. The apparatus for performing the method includes a billet hot shearing unit which has an adjustable longitudinal feed stop and cuts the billets to length. The billets are supplied to, and are processed in, a press in which a first length recorder measures the butt thickness and from which the extruded profile is drawn out by an extrusion drawing unit. A second length recorder measures the extrusion length. The measured actual values of the butt thickness and the extrusion length are supplied to a controller which compares them alternately with corresponding reference input values of the butt thickness or the extrusion length, respectively, and actuates a positioning element which adjusts the longitudinal feed stop such as to eliminate a difference between the reference and actual values.

9 Claims, 3 Drawing Figures prese-lection L
actual value p
actual value L
controller, computer
press ratio
correction ratio
ref. input value L x
ref. input value p x
controller computer
positio-ning element
controlled system
indication
actual value L
actual value p

METHOD OF AND AN APPARATUS FOR PRODUCING EXTRUSION PROFILES

BACKGROUND OF THE INVENTION

The invention relates to a method of and an apparatus for producing extrusion profiles having a desired extrusion length, in particular from cast metal billets.

In the extrusion of rods, tubes, profiles, and the like of metal, such as aluminum, normally an extruded profile is produced from a billet having a certain length. The length of the extruded profile depends on the billet length extruded and on the press ratio, i.e. the ratio between the pressing pad cross section and the extrusion cross section. The extruded billet length then corresponds to the billet length minus the length or thickness of a rest to be discarded, the so-called butt thickness.

The butt retains impurities contained in on or at the billet and protects the die from overload. The butt thickness is in the order of from 3 to 5% of the billet length and forms part of the waste produced in extrusion processes.

SUMMARY OF THE INVENTION

It is the object of the invention to produce extruded profiles of desired extrusion lengths, at a given approximately known press ratio, from billets having such a length that the butt thickness is as small as possible and maintained at the optimum rated thickness value which still contains some reserves as compared to the minimum permissible butt thickness with regard to the quality of the extruded profile and the permissible loading of the die.

To solve this problem, it is provided in a method of the kind defined initially, that (a) a billet of preselected billet length ("l") is processed, (b) the extrusion length (L) is measured during the extrusion process, (c) the extrusion process is switched off upon reaching of the desired extrusion length ($L_x$) and the billet length ("l") is varied so as to obtain the optimum butt thickness ($p_x$), or (d) the extrusion process is switched off upon reaching of the minimum permissible butt thickness ($p_o$) before the desired extrusion length ($L_x$) is reached and the billet length ("l") is enlarged so as to obtain the desired extrusion length ($L_x$).

An apparatus for carrying out this method is characterized by (a) a billet hot shearing unit comprising an adjustable longitudinal feed stop, (b) a press to which the billets cut to length by the billet hot shearing unit are supplied, (c) a first length recorder for measuring the butt thickness, associated with the press, (d) an extrusion drawing unit for drawing out the extruded profile, (e) a second length recorder for measuring the extrusion length, associated with the extrusion drawing unit, (f) a controller, whose inputs are reference input values and the measured actual values of the butt thickness and the extrusion length, respectively, and which effects a reference value-actual value comparison alternatively with respect to the butt thickness of the extrusion length in response to whether the reference input value of the extrusion length or the minimum permissible butt thickness is reached during the extruding process, and which generates actuating signals, and (g) a positioning element which adjusts the longitudinal feed stop of the billet hot shearing unit upon receipt of the actuating signals so as to eliminate the actuating signals which represent a difference beween said reference and actual values.

The method and apparatus according to the invention, on the one hand, permit a correct preselection of the extrusion length, thus avoiding the extrusion of unnecessary lengths of material. On the other hand, a minimum of billet length or original billet weight is required to obtain the desired extruded profile length. Together these two aspects afford the possibility of extruding under optimum utilization of the material, with the smallest possible amount of waste. Thus the method and apparatus according to the invention permit more economic operation than heretofore possible.

Conveniently the individual steps mentioned are repeated so many times, always using the newest billet length determined instead of the preselected billet length, that finally the actuating signal which represents a difference from a rated value or reference input value of the butt thickness becomes zero. This procedure is typical of a feedback control system. In the present case the butt thickness or the profile length represent the controlled variable, depending on whether the desired extrusion length is reached or failed to be reached during the first pressing, in other words whether the reaching of the minimum permissible butt thickness is signalled previously. In the latter event the deficiency in billet length, i.e. the enlargement of the billet length required to obtain the desired extrusion length is determined on the basis of the press ratio which is defined by the ratio between the pressing pad cross section and the extrusion cross section.

The feeback control may be effected in consideration of a correction ratio between the butt cross section and the billet cross section of the hot billet.

The controller is connected with a computer in which the actual data detected by the length recorders are compared with the reference input values at the end of an extruding process and processed to form the positioning or actuating signals. A third length recorder is provided to detect the billet length. The output signal of this recorder is also applied to the controller.

Conveniently each length recorder comprises a rotation pulse emitter with counter. Here the longitudinal displacement, which has been converted into rotation in per se known manner, is sensed in digital manner and transmitted to the computer in the controller as the actual value.

The positioning element conveniently comprises a positioning motor which adjusts the longitudinal feed stop by way of a screw spindle upon receipt of a positioning signal.

BRIEF DESCRIPTION OF THE FIGURES

The invention and advantageous details thereof will be described further, by way of example, with reference to the accompanying diagrammatic drawings, in which.

DETAILED DESCRIPTION

Figures 1, 2:
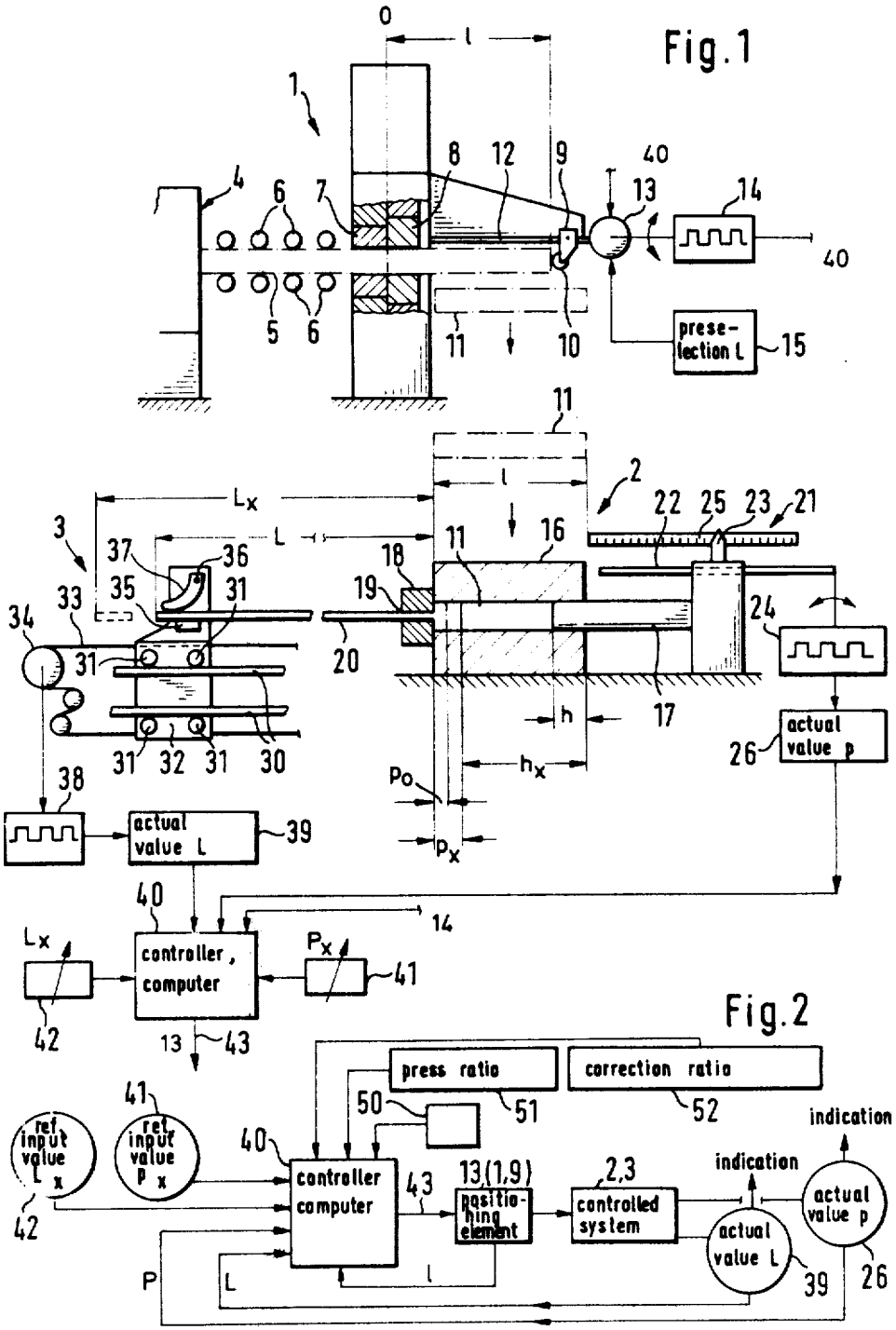
FIG. 1 is a diagram of the various component parts of an apparatus according to the invention and their combination to cooperate in accordance with the method of the invention.
FIG. 2 is a block diagram of a feedback control loop according to the invention.

In FIG. 1 the three principal component parts of the apparatus, namely a billet hot shearing unit 1, a press 2, and an extrusion drawing unit 3 are shown only diagrammatically since they are known per se. The billet hot shear may be of the design described in detail in German patent application DE-OS 26 04 418, laid open. From a preheating furnace 4 a billet 5 is fed to the billet hot shearing unit by a roller guide means comprising rollers 6 and then passed through a stationary shear ring 7 and a movable shear ring 8 up to an adjustable longitudinal feed stop 9, including an abutment roller 10. The vertically movable shear ring 8 serves to cut the material supplied into billets 11 of predetermined length "l".

As the longitudinal feed stop 9 is adapted to be displaced in longitudinal direction on a spindle 12 by means of a positioning motor 13, the length "l" of the billet is variable. An electronic rotation pulse emitter 14 is coupled to the positioning motor 13. In combination with a counter (not shown) it serves for digitally sensing a change in position of the longitudinal feed stop 9 and thus a variation in length "l" of the billet, which length "l" is measured from the shear edge designated O and located in the vertical plane between shear rings 7 and 8. A first billet length "l" can be preselected by means of a selector 15.

The sheared-off billet 11 having a length "l" is supplied to the container 16 of the press 2 where it is processed by means of a ram 17, constituted by the extrusion stem and the pressing pad ahead of the same (not shown), extruding the billet through a die 18 which has an orifice 19 corresponding to the desired cross sectional shape of the extruded profile. It is not the entire length "l" of the billet which is being extruded, but instead a length reduced by the thickness of the butt $p_x$ which corresponds to the press stroke $h_x$. The butt thickness must not be less than the minimum permissible butt thickness $p_o$. The optimum rated value of the butt thickness p which still warrants satisfactory quality of the extruded profile 20 and, moreover, guarantees that the die 18 is not subjected to undue stress is somewhat greater than the smallest permissible butt thickness $p_o$.

A length measuring instrument 21, including a screw spindle 22 which is rotated by advancing the ram 17, a rotation pulse emitter 24, including a counter (not shown), a linear scale 25, an indicator 23 moved along with the ram 17 all are associated with the ram 17. Thus the actual value p of the butt thickness can be determined which is derived from the press stroke h, as illustrated by block 26 in FIG. 1.

The extrusion drawing unit 3 comprises a carriage 32 which is supported on rollers 31 for movement along a pair of rails 30 arranged in parallel with the extruded profile 20. The carriage is driven by a motor 34 acting through a chain 33. The extruded profile 20 is grasped by the carriage by means of a fixed jaw 35 and a parabolic jaw 37 adapted to swing about a pivot 36, the jaws taking along the extruded profile until the desired extrusion length $L_x$ has been reached or the press stroke $h_x$ has terminated upon reaching the minimum permissible butt thickness $p_o$. The actual length L of the extruded profile is detected by a rotation pulse emitter 38 associated with the motor 34 and forming the actual value L (block 39 in FIG. 1). The actual values of the butt thickness p (from block 26 in FIG. 1) and of the extrusion length L (from block 39 in FIG. 1) are applied to a controller 40 and an associated computer. The controller and computer also receive the output signal of the rotation pulse emitter 14, which signal is representative of the respective billet length "l".

Furthermore, reference input values $p_x$ and $L_x$ of the optimum butt thickness and desired extrusion length, respectively, are applied to controller 40, these values being adjustable, for instance, by potentiometers at reference input adjusters 41, 42. Additional inputs into the controller 40 and computer are fixed adjustment values of the minimum permissible butt thickness $p_o$, the pressing ration defined initially, and the correction ratio likewise defined initially, the input of these values being effected through corresponding input means 50, 51, 52. Based on these values the controller 40 and computer form a quantitative controller output signal which is applied from output 43 to positioning motor 13 of longitudinal feed stop 9 for a corresponding change of the billet length "l" in a follow-up open loop control. The change made is reported back to the controller and computer through a "feedback l" so as to terminate the adjustment of the longitudinal feed stop 9 as soon as the calculated value has been attained.

Figure 3:
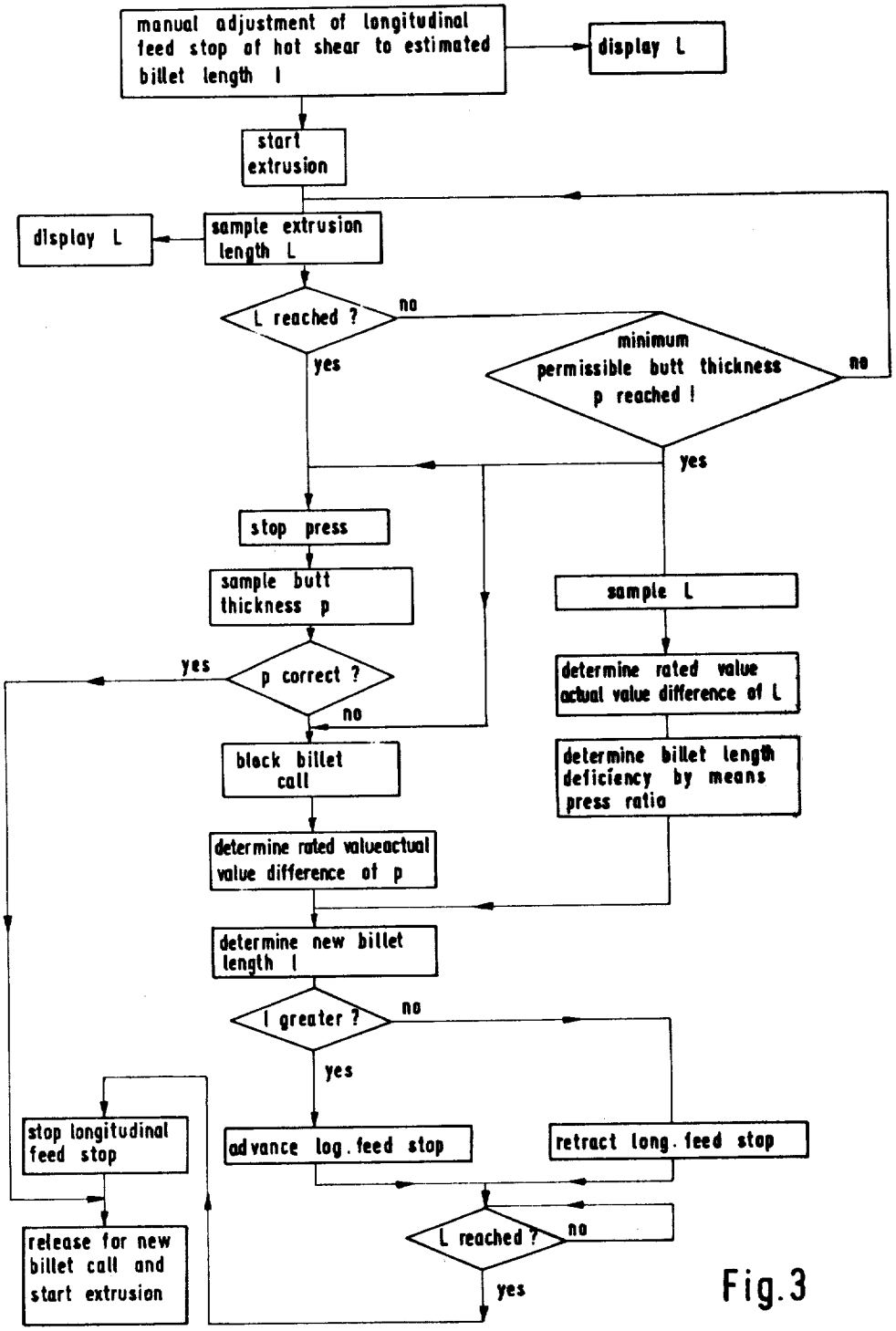
FIG. 3 is a flow chart illustrating the course of the process in an easily understandable sequence of the individual steps taken.

The functioning and mode of operation of the method and apparatus shown in FIG. 1 will be understood by reference to FIGS. 2 and 3. The block diagram of the feedback control loop according to FIG. 2 shows the individual blocks of the feedback control loop with the same designations as used in FIG. 1. The controlled variable is the actual butt thickness p or, in case of insufficient billet length "l", the extrusion length L. The controlled system is formed by the press 2 and the drawing unit 3. The actual values of the butt thickness p are determined by the length measuring instrument 21 or in block 26, while the actual values of the extrusion length L are formed by means of rotation pulse emitter 38 in block 39. These values are applied to the controller 40 and computer to which the reference input values $p_x$ and $L_x$ of the butt thickness and extrusion length, respectively, are applied as well from reference input adjusters 41, 42. Further inputs into the controller and computer are the additional data mentioned, namely the minimum permissible butt thickness $p_o$, the press ratio, and the correction ratio. The customary comparison between rated or reference values and actual values is made in the controller and computer and, based on such comparison, an actuating signal generated at the output 43 is applied to the positioning motor 13 to adjust the longitudinal feed stop 9 of the billet hot shearing unit 1 and thus vary the billet length "l" so as to eliminate the actuating signal. The reference input values $p_x$ and $L_x$ are used alternatively. If the desired extrusion length $L_x$ is reached without failure of the press to reach the minimum permissible butt thickness $p_o$, the reference input value $p_x$ of the butt thickness is compared in the controller with the actual value of the butt thickness. The billet length "l" then is increased or decreased in dependence on the actuating signal, i.e. in response to a positive or negative difference between the reference input values and the actual values.

If, on the other hand, the minimum permissible butt thickness $p_o$ is reached before the desired extrusion length $L_x$ is obtained, the extrusion length $L_x$ is taken as the reference input value and compared with the actual value of the extrusion length L. In this case the controller and computer determine the lacking billet length on the basis of the difference between the actual extrusion length and the reated extrusion length, utilizing the press ratio, to generate a corresponding signal to be applied to positioning motor 13 for enlargement of the billet length "l".

In detail of course of the individual steps in applying the apparatus according to FIG. 1 may be taken directly from FIG. 3.

We claim:

1. A method for producing from a series of billet blanks a plurality of extrusion profiles each having a given first longitudinal dimension, and a plurality of corresponding billet remnants each having a given second longitudinal dimension, comprising the steps of (a) severing a first billet (11) to a predetermined length (l);

(b) initiating longitudinal extrusion of said first billet, thereby to progressively form said billet into an extrusion profile portion and a billet remnant portion;

(c) continuously measuring during the extrusion process the longitudinal dimensions of both the extrusion profile and billet remnant portions, respectively;

(d) interrupting the extrusion process when one of said dimensions reaches its predetermined value; and (e) adjusting the predetermined length to which the next succeeding billet is severed in accordance with said measured dimensions, whereby the extrusion profile and billet remnant produced from the next succeeding billet will have dimensions more closely approximating the given first and second longitudinal dimensions, respectively.

2. The method as defined in claim 1, wherein the adjustment of the next succeeding predetermined billet severance length is determined by the ratio of the cross-sectional areas of the extrusion pressing pad to the extrusion orifice, respectively.

3. The method as defined in claim 1, wherein the steps are repeated for each succeeding billet blank whereby the resulting extrusion profiles and billet remnants have dimensions substantially equal to the given first and second longitudinal dimensions, respectively.

4. The method as defined in claim 1, wherein the ratio of the cross-sectional area of said billet remnant to the cross-sectional area of said billet comprises a correction factor for adjustment of the next succeeding billet severance length.

5. Apparatus for producing from a series of billet blanks a plurality of extrusion profiles each having a given first longitudinal dimension, and a plurality of corresponding billet remnants each having a given second longitudinal dimension, comprising (a) adjustable billet severing means for severing a first billet to a predetermined length;

(b) extrusion means receiving said first billet to progressively form said billet into an extrusion profile portion and a billet remnant portion;

(c) first measuring means for measuring the longitudinal dimension of the extrusion profile portion;

(d) second measuring means for measuring the longitudinal dimension of the billet remnant portion; and (e) computer means receiving the measurements from said first and second measuring means, said computer means including (1) comparison means for generating a first signal representing the difference between the first measurement and the given first longitudinal dimension and a second signal representing the difference between the second measurement and the given second longitudinal dimension; and (2) control means responsive to said first and second signals to adjust the predetermined length of said severing means for the next succeeding billet, whereby the extrusion profile and billet remnant produced from the next succeeding billet will have dimensions more closely approximating the given first and second longitudinal dimensions, respectively.

6. Apparatus as defined in claim 5, and further comprising (f) third measuring means for measuring the longitudinal dimension of said billet, the measurement from said third measuring means being delivered to said control means as a feedback signal to indicate to the control means the adjustment in length of said severing means for the next succeeding billet in response to said first and second signals.

7. Apparatus as defined in claim 6, wherein said first, second, and third measuring means each comprise a rotation pulse emitter and a counter.

8. Apparatus as defined in claim 5, wherein said adjustable billet severing means comprises (1) a rotatable longitudinal screw spindle;

(2) a longitudinal billet feed stop mounted on said spindle for displacement thereon; and (3) positioning means responsive to said controller means for rotating said spindle to displace said feed stop to a position in accordance with the billet severence length.

9. Apparatus as defined in claim 8, and further comprising manually adjustable given dimension input means and manually adjustable billet severence length input means.

* * * * *